US006059146A

United States Patent [19]

Meisner et al.

[11] Patent Number: 6,059,146

[45] Date of Patent: May 9, 2000

[54] LIQUID DELIVERY SYSTEM THAT AUTOMATICALLY DELIVERS LIQUID FROM A PLURALITY OF CONTAINERS

[75] Inventors: Edward H. Meisner, Riva, Md.; Keith C. Kristiansen, Stratford, Conn.; Michael P. Ballone, New Providence, N.J.

[73] Assignee: Perrier Group of America, Greenwich, Conn.

[21] Appl. No.: 09/124,433

[22] Filed: Jul. 29, 1998

[51] Int. Cl.[7] ..... B67D 5/56

[52] U.S. Cl. ..... 222/145.1; 222/64; 222/66

[58] Field of Search ..... 222/145.1, 65, 222/64, 66, 67

[56] References Cited

U.S. PATENT DOCUMENTS

| | | | |
|---|---|---|---|
| 1,078,214 | 11/1913 | Patnaude . | |
| 3,930,598 | 1/1976 | Slagle | 222/145.1 |
| 4,274,557 | 6/1981 | Shannon | 222/145.1 |
| 4,406,247 | 9/1983 | Baughman et al. | 222/65 |
| 4,601,409 | 7/1986 | DiRegolo | 222/145.1 |
| 4,699,188 | 10/1987 | Baker et al. . | |
| 4,903,862 | 2/1990 | Shannon et al.. | 222/65 |
| 5,105,858 | 4/1992 | Levinson . | |
| 5,121,778 | 6/1992 | Baker et al. . | |

OTHER PUBLICATIONS

SHURflo, a Wicor Company; Bottled Water Delivery System; two pages "Rev. Sep. 1996".

Elkay Manufacturing Company; Flushtop Watersafe™ System; two pages; "92951C Rev. C".

*Primary Examiner*—Steven O. Douglas

*Attorney, Agent, or Firm*—Kramer Levin Naftalis & Frankel LLP

[57] ABSTRACT

A system for delivering liquids from a plurality of containers. The system has a dispenser which holds the containers in a generally side by side relationship. A unit of the system is connected to each of the containers for sequentially dispensing the liquid held by the containers to a reservoir for receiving such liquid. The unit has conduits which are connected to the openings of the container and which extend into and have openings therein at different depths in the reservoir for the sequential dispensing of the liquid from the containers into the containers. A delivery system unit is connected to the reservoir for providing the liquid to one or more outlets. The containers are removable from the system as they become empty and are replaceable with fresh ones, to thereby allow the system to continue to deliver liquid, such as bottled water.

16 Claims, 12 Drawing Sheets

LIQUID DELIVERY SYSTEM THAT AUTOMATICALLY DELIVERS LIQUID FROM A PLURALITY OF CONTAINERS

FIELD OF THE INVENTION

The present invention generally relates to a liquid delivery system, and is more particularly directed to a water delivery system that automatically delivers water from a plurality of bottles to one or more outlets.

BACKGROUND OF THE INVENTION

Water dispensing units, such as water coolers and the like, conventionally, dispense water from a single container, such as a five gallon bottle which sits atop of the water cooler. In an office or commercial environment, or in a home where a great deal of water is consumed, the bottle must be frequently changed to replenish the water supply.

Further, where efforts have been made to dispense bottled water to an outlet, without using a water cooler, generally available systems still use a single container, e.g., the five gallon bottle. Once again, the water bottle has to be changed on a relatively frequent basis to replenish the water supply.

SUMMARY OF THE INVENTION

The present invention overcomes the described drawbacks and provides a new and unique system, which has the capacity to provide comparatively substantial quantities of liquids (e.g., water) by using a plurality of relatively large containers, which has the capability of providing liquid to one or more outlets, which can be maintained at different locations near or remote from the one or more liquid outlets, which can be replenished easily and on a less frequent basis, and which can operate automatically and continuously. In accordance with the present invention, the system includes a dispenser for holding a plurality of containers (e.g., five gallon bottles of water) at a desired location relative to the one or more outlets, and a unit for automatically and sequentially dispensing the liquid from one or more (but not all) of the containers. Preferably, the containers are held by the dispenser generally along side one another, and the dispensing unit is connected to each container and dispenses the liquid from the containers in a sequential manner. For example, when a container becomes depleted the next container is ready and can supply liquid without interruption. The unit dispenses the liquid into a reservoir which holds the liquid provided by the containers. Preferably, the system holds the containers above the reservoir in an inverted manner such that their openings are facing downward toward the reservoir. The system also can include a pump for conveying liquid from the reservoir to at least one other outlet, such as a faucet.

In a preferred embodiment, the dispensing unit includes conduits, which are connected to the openings of the inverted containers and which extend into the reservoir and have openings therein at different depths in the reservoir. To accomplish this, the conduits, for example, can have different lengths with opening at their ends, the conduits can be of the same length while the containers are held at different heights relative to the reservoir, or the conduits can have openings therein at different positions along their lengths. In operation, the bottled liquid initially flows from the containers, through the conduits into the reservoir until openings therein are below the liquid level. At this point, the pressure of the liquid in the reservoir restricts the flow of liquid from the submerged conduit openings. When liquid is demanded by an outlet, the liquid flows from the reservoir and sequentially the conduit openings become uncovered and are no longer submerged. As a conduit opening becomes uncovered, the restricting liquid pressure is eliminated and liquid from the connected container(s) can and does flow through the opening and into the reservoir. This operation continues as the containers are sequentially emptied. Preferably, as the last container (or containers) is being emptied, the already emptied container(s) can be removed and replaced. In this way, the system is easily and quickly replenished without interruption and can operate on a continuous basis.

In accordance with an embodiment of the present invention, the system includes a tray positioned above the reservoir. The tray includes receptacles for receiving and holding the containers. The receptacles preferably are contoured to the configurations of the containers, and the receptacles have openings positioned above the reservoir for allowing the contained liquids to flow from the conduits and into the reservoir. Where the conduits of the dispensing unit are of differing lengths and the reservoir openings are in the ends thereof, the receptacles are of the same height, and where such conduits have such openings but are of equal lengths, the receptacles are at different heights.

In each of the described embodiments, the system can include one or more devices to indicate when the containers should be replaced. In one embodiment, the device can be connected to the reservoir and the pump, and the device will shut off the pump when the liquid in the reservoir drops below a predetermined level, thereby indicating that the reservoir needs to be replenished. In another embodiment, the device can float on the water in the reservoir and provide a signal when the level of the liquid in the reservoir approaches the predetermined level, thereby allowing time to replace the empty containers with full ones before the system is shut off.

Also, there can be a plurality of the liquid outlets operatively connected to the reservoir by a supply line or lines, each outlet being separately actuatable to dispense liquid from the reservoir. A chilling device and/or a heating device also can be provided in a supply line to provide the chilled or heated liquid at the outlet.

While the preferred liquid is bottled water, other contained liquids can be used with the system of the present invention, including beverages, such as soft drinks, juices, milk, tea, coffee and the like. Also, the liquids can be held in containers or bottles which contain more or less than five gallons. For example, they can hold 3 or 10 gallons.

DETAILED DESCRIPTION OF THE PREFERRED EMBODIMENTS

Figure 1:
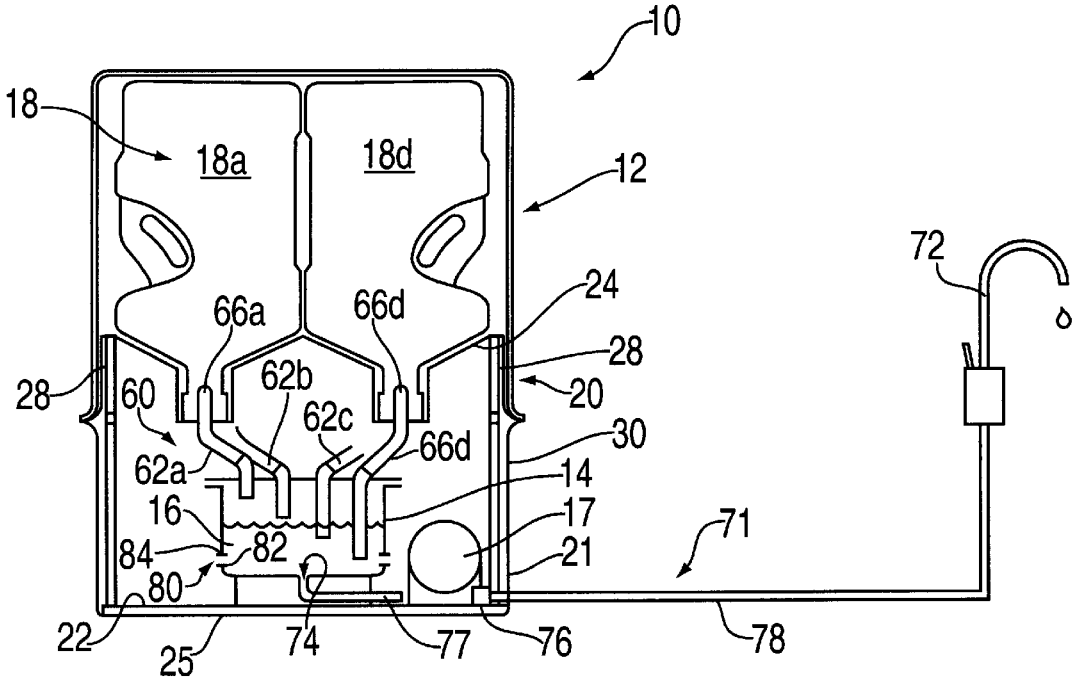
FIG. 1 is a schematic view of an embodiment of the system according to the present invention.

Referring now to the drawings and initially to FIGS. 1–4, there is shown a water delivery system 10 of the present invention which automatically and sequentially delivers water. The system 10 includes a dispenser 12 within which is a reservoir 14 for holding water 16, a plurality of containers, such as five gallon bottles, generally designated by the reference numeral 18, which are held in position above reservoir 14, and a pump 17 for delivering the water from the reservoir 14 to one or more sources or outlets, as will be explained later, in greater detail.

Figure 3:
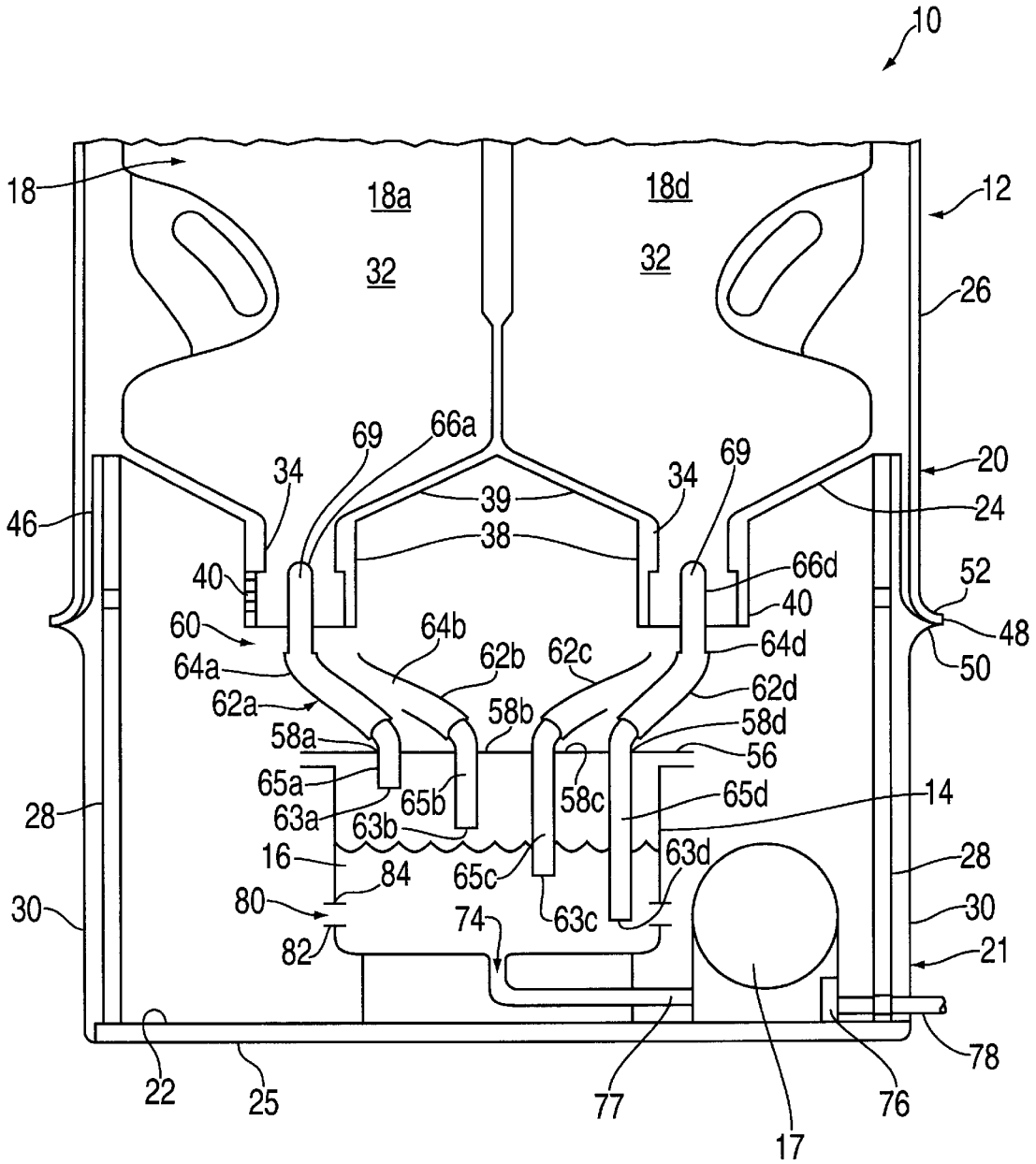
FIG. 3 is an enlargement of a portion of the vertical cross sectional view of the dispenser of FIG. 1.
Figure 4:
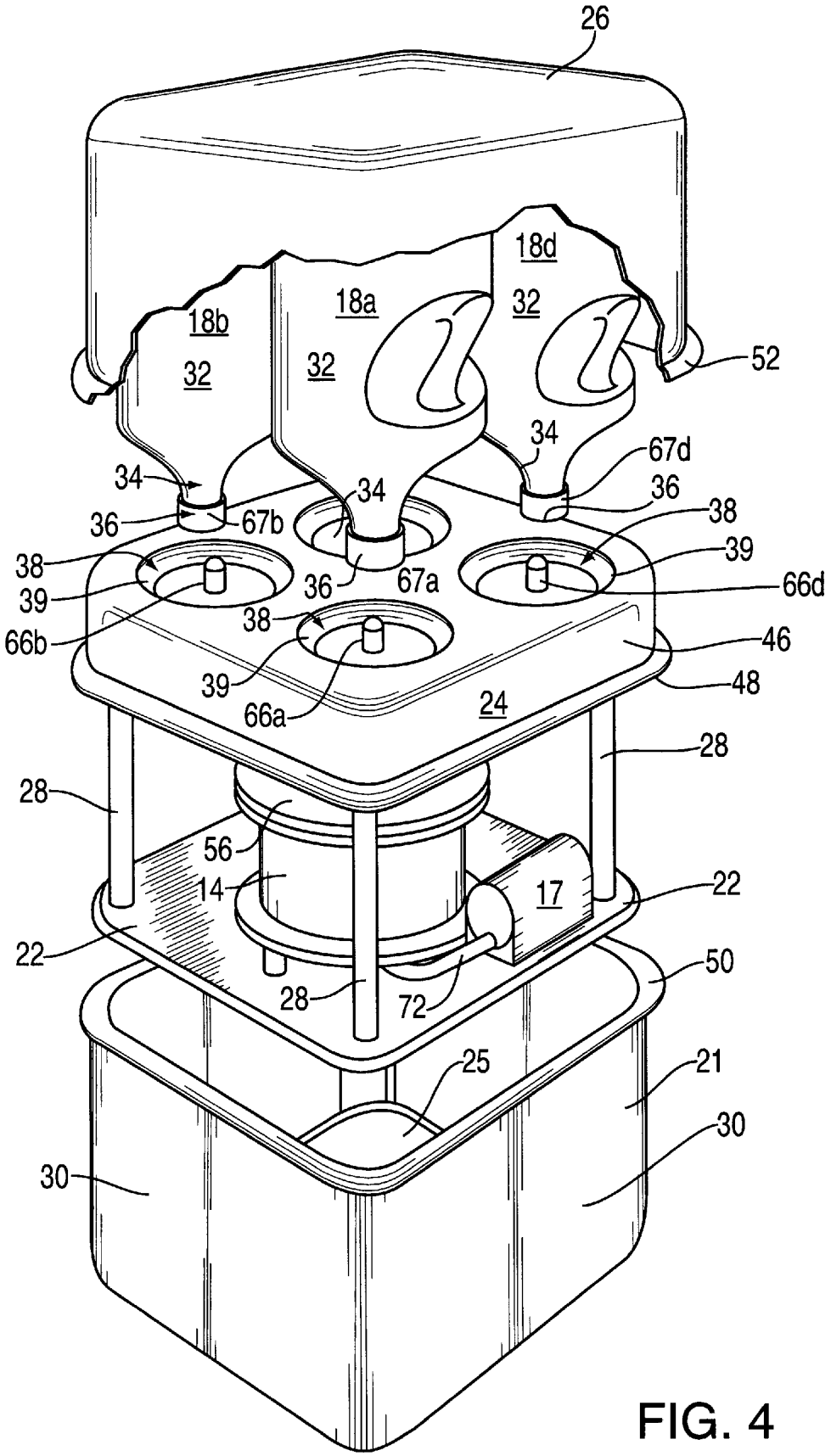
FIG. 4 is an exploded and perspective view of the dispenser of FIG. 1 without the conduits of the dispensing unit.

As best illustrated in FIGS. 3 and 4, the dispenser 12 includes a housing 20 having a bin 21, a separate base 22 upon which the reservoir 14 and the pump 17 are removably mounted, a tray 24 suspended above the reservoir 14 which holds the bottles 18, and a removable cover 26 which encloses the bottles 18. The base 22 and the tray 26 are held in spaced relationship by posts 28 which are positioned within the bin 21 and which are removably bolted to the components 22 and 26.

The bin 21 has a bottom wall 25 upon which the base 22 normally rests, and four equal side walls 30 which extend upwardly and about the reservoir 14.

Figure 2:
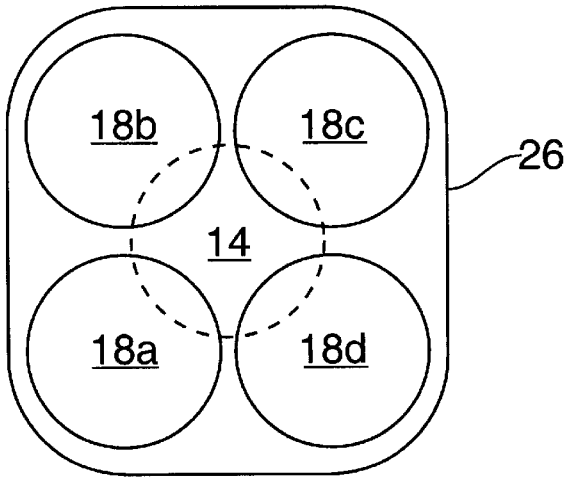
FIG. 2 is a plan view, partially in section, of FIG. 2.

As illustrated in FIGS. 2 and 4, the system 10 holds four bottles 18*a, b, c* and *d*, wherein each bottle has a body 32 for holding the water and a neck 34 with a capped opening 36 from which the bottled water is delivered (FIG. 4). The illustrated bottles 18 also have ergonomic features as disclosed in United States patent application, Ser. No. 09/083,183, filed Jan. 23, 1998. The copending application is owned by the assignee of the present application and the disclosure of the copending application is incorporated herein.

The tray 24 includes receptacles 38 for the bottles 18*a–d* (FIG. 4). The receptacles 38 have inwardly inclined surfaces 39 with downwardly extending spouts 40 contoured to support and receive the similarly contoured portions and tapered necks of the bottles 18 (FIG. 3). When the described components have been assembled, the spouts 40 are positioned above the reservoir 14. As shown in FIG. 4, the tray 24 also has an outer depending wall 46 with a lower outwardly extending flange 48 that can rest on an outwardly extending flange 50 extending from the walls 30 at the top of the bin 21. In turn, the cover 26 has a lower outwardly extending flange 52 which can rest on the flange 48 of the tray 24, and the described three flanges can be releasably secured together. Thus, the described assembly has a nesting or sealing relationship for hygienic purposes while, at the same time, its components readily can be separated or disassembled.

Correspondingly, the reservoir 14 as shown in FIGS. 3 and 4 is circular and is hygienically sealed by a removable lid 56 (FIGS. 1, 3 and 4) which has four spaced apart ports 58*a, b, c* and *d* extending therethrough (FIG. 3). Typically, the reservoir has a capacity of about 2 gallons.

Figure 5:
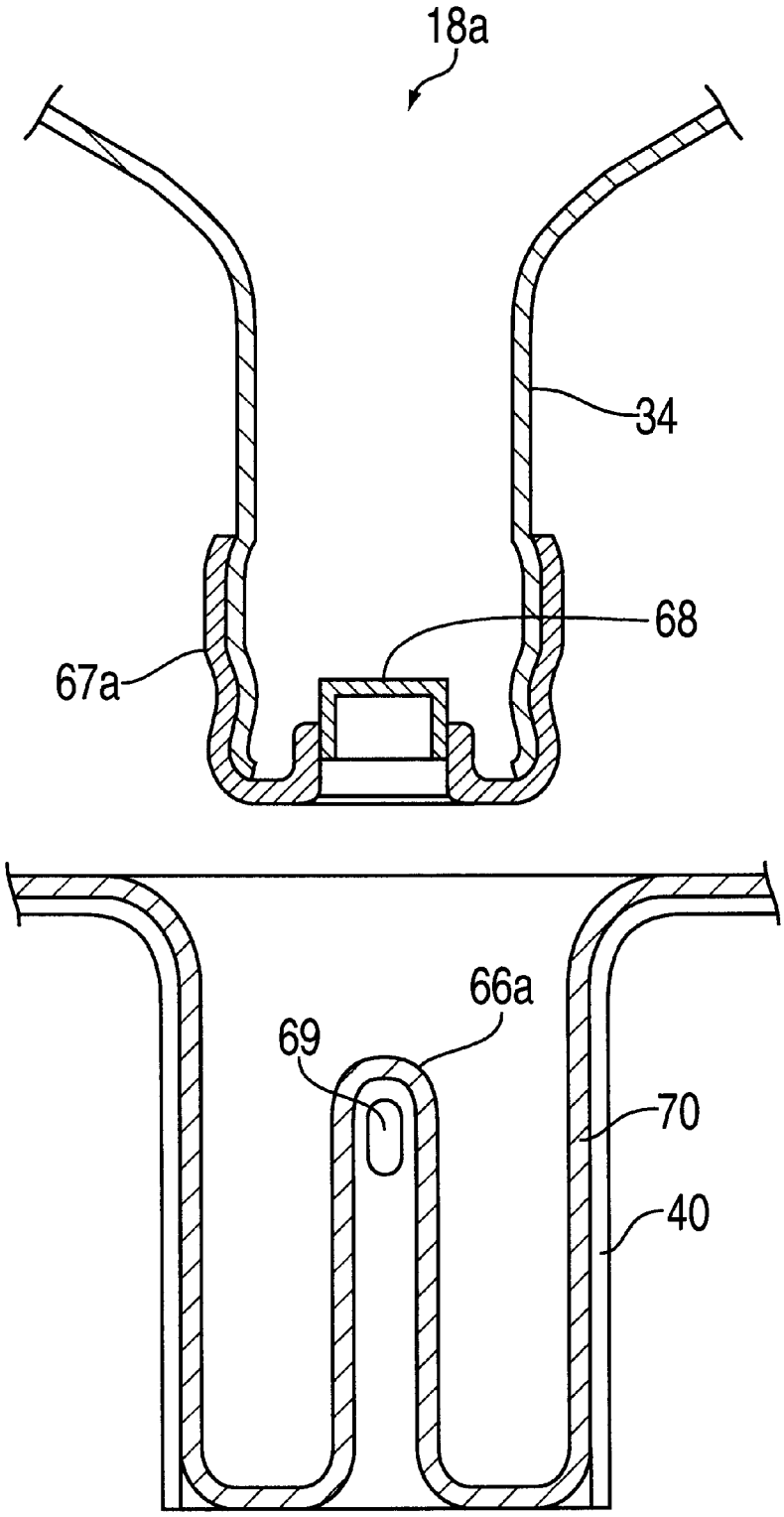
FIG. 5 is an enlarged, partially sectional view of a probe and a capped container shown in FIGS. 1, 2 and 4.
Figure 6:
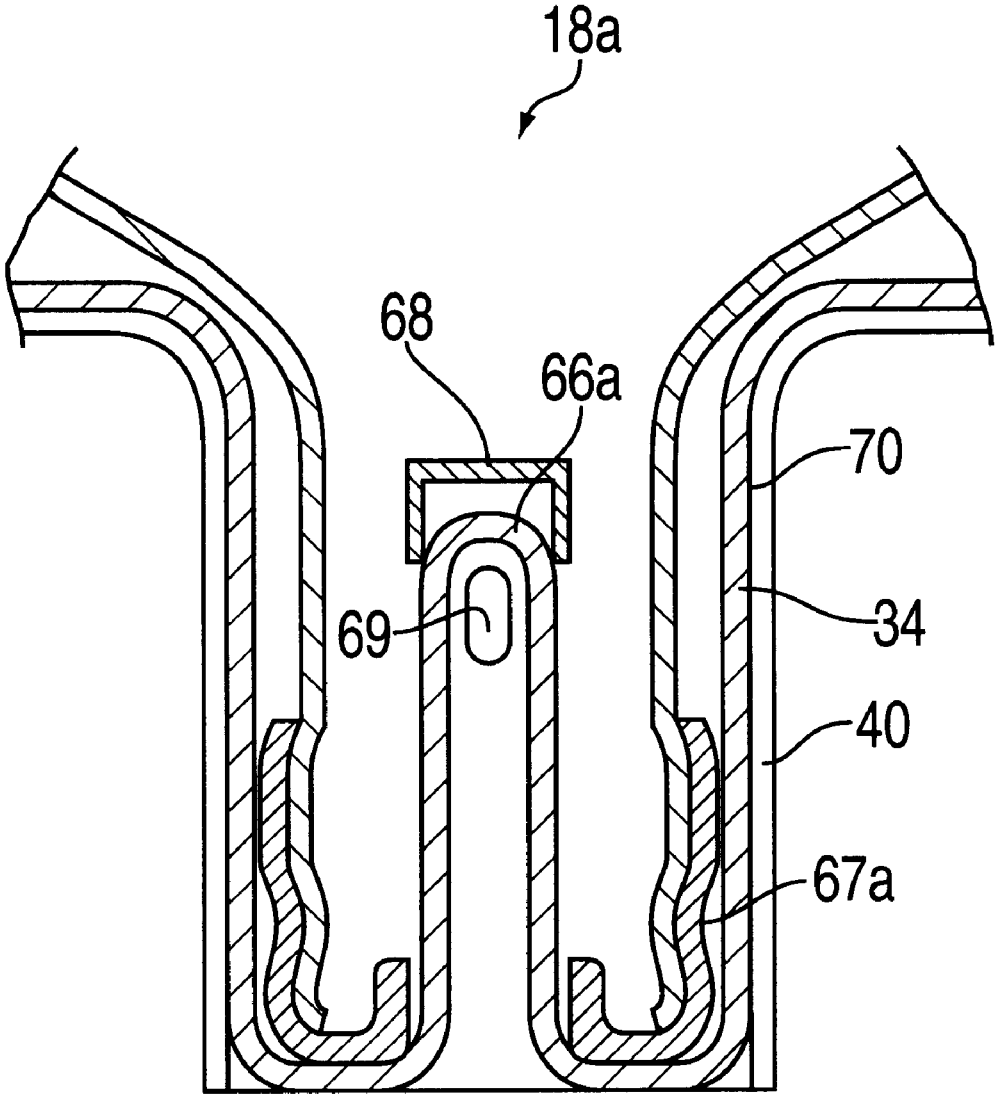
FIG. 6 is a view similar to FIG. 5 with the probe engaging and unseating a resealable plug of the capped container.

The dispenser 12 has a unit 60 for automatically and sequentially dispensing water, preferably from one of the illustrated bottles 18*a–d* at a time. As shown in FIGS. 1 and 3, the dispensing unit includes conduits 62*a, b, c* and *d* of different lengths connected at one end into the inverted capped bottles and extending, at the other end, into the reservoir 14 to different depths. Each conduit 62*a–d* comprises an upper flexible tube 64*a–d* and a lower rigid tube 65*a–d*. Each flexible tube 64*a–d* has an upper end connected to an inverted bottle 18*a–d* via a probe 66 through which water can flow. As shows in FIGS. 5 and 6, the caps 67*a–d* for the bottles 18 have a movable and resealable plug 68, and each probe 66 includes a flow through opening 69 with an outer contoured guide 70, which slidably fits in a spout 40. In general, and as shown in FIG. 6, when the filled bottle 18 is inverted and inserted into its receptacle, e.g., 38, the probe 66 engages and unseats the plug 68, to thereby allow the flow of water from the bottle 18, through the opening 69 and the probe 66 into the flexible tube 64 of the conduit 62.

The lower ends of the flexible tubes 64*a–d* are connected to the upper ends of the rigid tubes 68*a–d*. As particularly shown in FIG. 3, the rigid tubes 68*a–d* slidably fit in and extend through the ports 58*a–d* of the reservoir lid 56. The upper ends of the rigid tubes 65*a–d* are of the same height relative to one another and they are directed to their respective bottles 18*a–d*. The lower ends of the rigid tubes 65*a–d* having openings 63*a–d* and extend into the reservoir 14 to different depths relative to their differing lengths.

In this embodiment, and as shown in FIG. 3, the water initially can flow from the bottles 18 until the reservoir 14 is filled up to, and including, the lower openings 63*a–d* of the conduits 62*a* and *b*. As shown, the water pressure prevents the flow of water 16 from the bottles 18*c* and *d* via conduits 62*c* and *d*. On the other hand, there is no such restricting pressure (that is, water pressure), preventing the flow of water from the bottles 18*a* and *b* through the conduits 62*a* and *b* because their lower openings 63*a* and *b* remain above the water level in the reservoir 14. As a result, the contents of the bottles 18*a* and *b* are free to flow into the reservoir 14 until the bottom openings 63*a* and *b* of the conduits 62*a* and *b* are below the water level in the reservoir 14.

As water is removed from the reservoir 14, the surface or water level again can drop below the lower opening 63*a* of the conduit 62*a* until the bottle 18*a* is emptied and next below the lower opening 63*b* of the conduit 62*b* until the bottle 18*b* is emptied. Sequentially, and as the demand for water continues, the water will drop below the lower openings 63*c* and 63*d* of the conduits 62*c* and *d* (that is after the bottles 18*a* and *b* have been emptied). At that point, the restrictive water pressure has been removed and water will flow first from the bottle 18*c* through the conduit 62*c* and then when the restrictive water pressure has been removed from the conduit 62*d*, the water from bottle 18*d* will flow through the conduit 62*d* into the reservoir 14. In the practice of the invention, the number of bottles 18 used can differ (e.g., 2, 3, 5 or 6) and the respective number and lengths of the conduits 62 will respectively differ. The dispensing unit 60, however, will continue to provide a controlled, automatic and sequential emptying of the bottles 18 into the reservoir 14.

For delivering water received by the reservoir 14, a delivery unit 71 is provided (FIG. 1). The unit 71 provides the water 16 from the reservoir to one or more outlets 72. The delivery unit 71 includes a supply line or conduit 77 connected at one end to an outlet opening 74 in the lower portion of the reservoir 14 and connected at its other end to the pump 17. The pump 17 has a pressure switch 76. The pump 17 is designed to pump the desired amount of water to one or more outlets 72 via a supply line or conduit 78. For example, a pump which provides 1.0 to 3.0 gallons per minute of water through the supply line 78 to an outlet 72 (e.g., a faucet) has been found to be satisfactory. Suitable pumps are marketed by Aquatech Water Systems of Irvine, Calif., such as models from its CDP series.

As stated, the pump 17 is connected to the supply line or conduit 78 which is connected to one or more outlets 72, such as water faucets, refrigerator ice makers and water dispensers, coffee makers or other means for dispensing or using liquids, such as bottled water. When an outlet 72 is opened, the pressure switch 76 senses a change in pressure within the appropriate supply line 78, that is, that the pressure within such supply line 78 decreases. This normally causes actuation of the pump 17 to pump water from the reservoir 14 to the outlet 72. Once the outlet 72 is closed, such that the flow of water is terminated, the pump 17 normally will continue to remove water from reservoir 14 until the pressure within the supply line 78 is increased to a predetermined level. Once the pressure in the supply line 78 is increased to the predetermined level, the pressure switch 76 senses the same and automatically deactivates the pump 17. The system 10 can continue to operate in this manner until the water in reservoir 14 reaches a predetermined level. At this point, the system 10 will halt operation regardless of the demand until a fall bottle or bottles 18 replace the empty ones. At that point, normal operation can resume.

Figure 7:
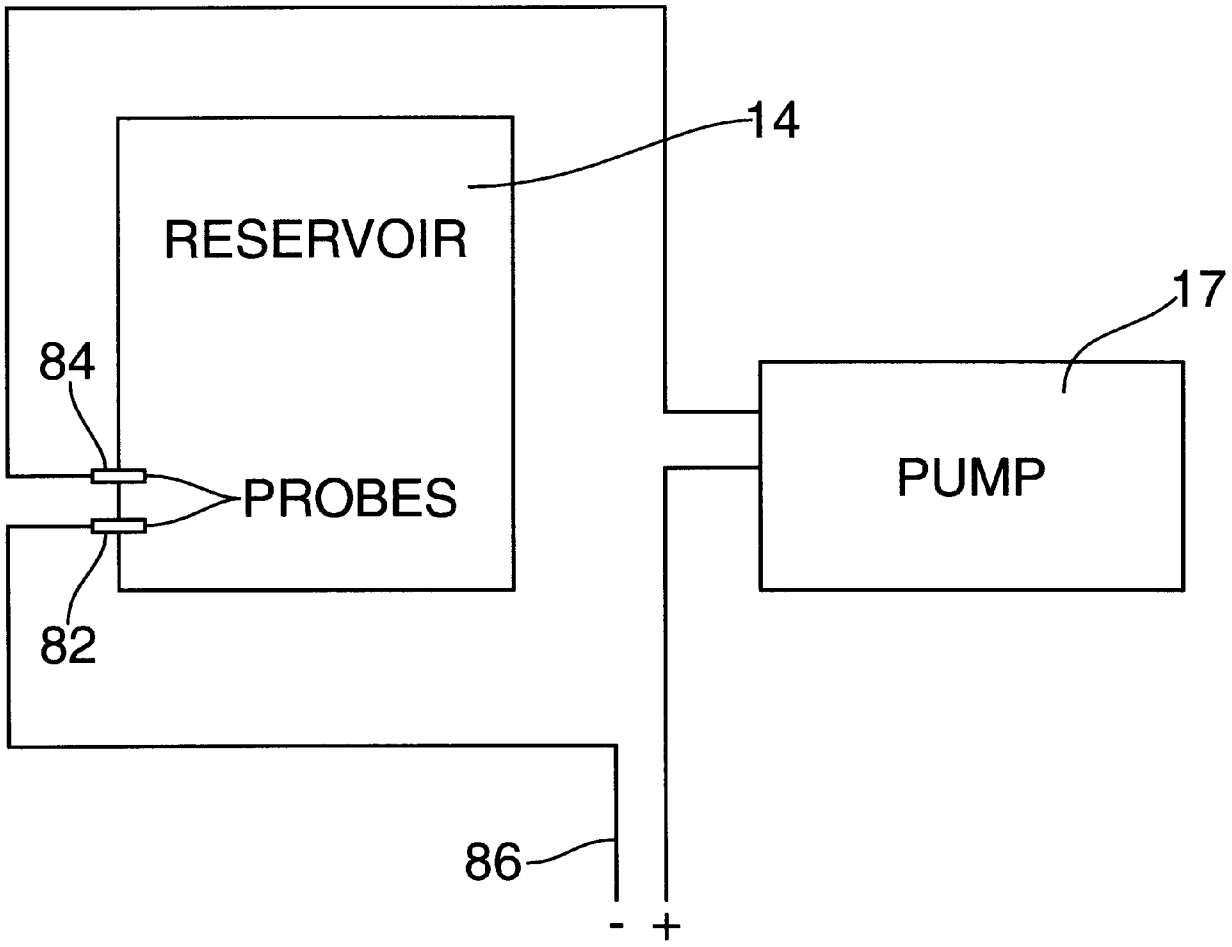
FIG. 7 is a schematic view of a device, partially illustrated in FIG. 1, which shuts off the pump when the level of the water in the illustrative reservoir drops below a predetermined level.

As stated, one or more of the supply lines 78 are pressurized only as long as the water from the reservoir 14 is above or at a predetermined level, such as at about 1.5 quarts. When the water in the reservoir 14 drops below that level the water flow stops. In one embodiment, the "shut-off" reservoir level is maintained by the device 80 shown in FIGS. 3 and 7. The device 80 includes a pair of probes 82 and 84 extending into the reservoir 14 at the desired shut off or predetermined level, and an electrical source 86 is connected to the probes 82 and 84 and to the pump 17. When the water level is above the probes 82 and 84, the current flows from the source 86 to the lower probe 82 and to the upper probe 84 via the water therebetween, and then from the upper probe 84 to the pump 74 and to the electrical source 86. When the level of the water drops below the upper probe 84, the circuit is broken because the current cannot flow between the probes 82 and 84 and the operation of the pump 17 is halted.

Figure 8:
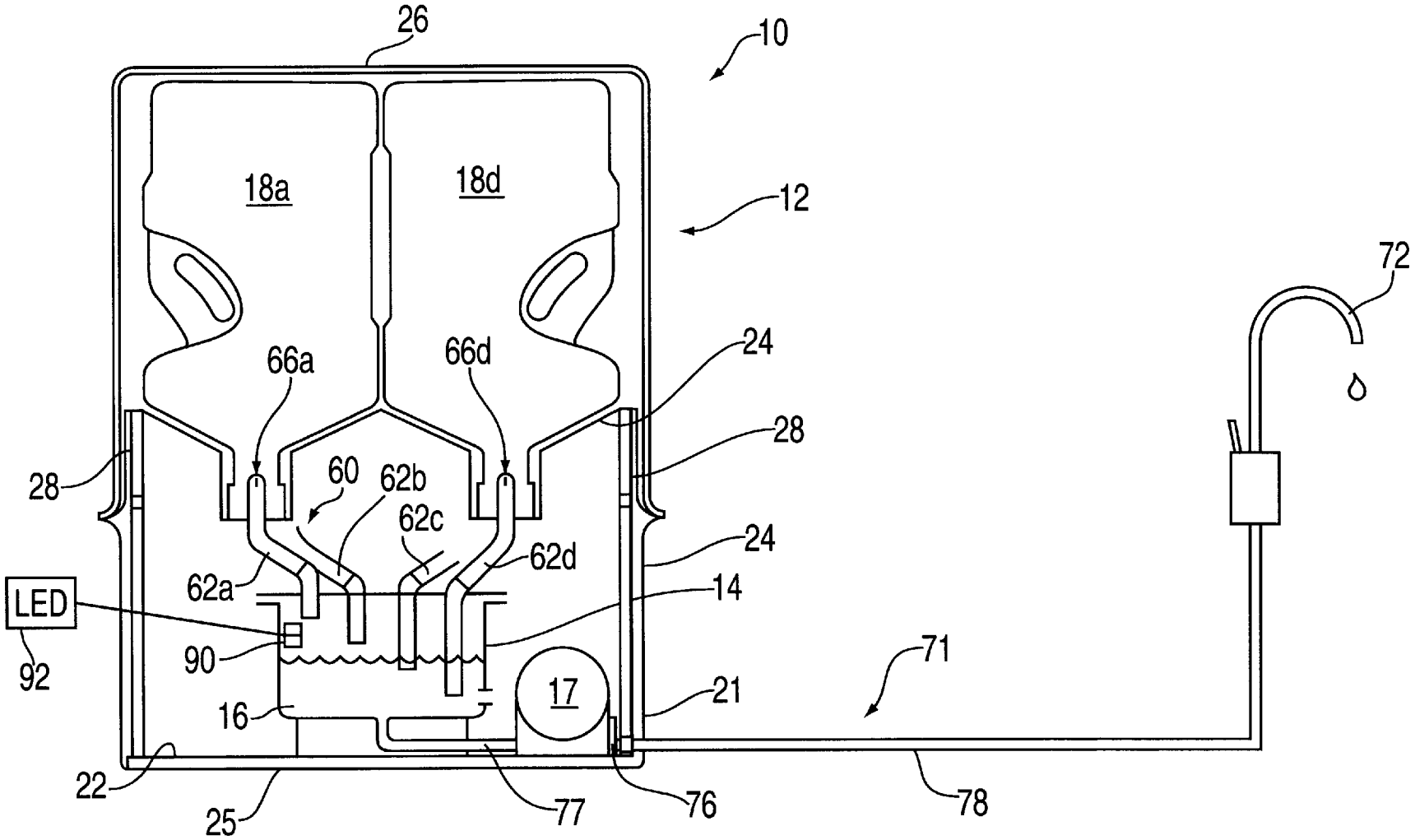
FIG. 8 is similar to FIG. 1, except that an embodiment or an indicating device is illustrated which can be used prior to when the system shuts off.

In another embodiment, and as shown in FIG. 8, an indicating device 88 can be used which includes a float switch 90 in the reservoir 14. The float switch 90 is connected to a LED 92. In this instance, when the float switch 90 approaches the predetermined level, which can correspond to the level of water 16 associated with the last bottle 18*d*, the float switch 90 closes a circuit and illuminates the LED 92 to advise that the water supply should be replenished before the water drops to the shut off level.

The control or indicating devices of the present invention, such as devices 80 and 88 can be used separately or together. Also, an indicator, e.g., the LED 92, can be provided at the reservoir 14, at each outlet 72 or at other locations, to indicate (e.g., to the user) that the water supply should be replenished. When a shut off device of the present invention provides its indication, the cover 26 can be removed, the empty bottles, e.g., 18*a, b* and *c*, should be removed and replaced by filled bottles. All this can be alone while the bottle 18*d* is still providing water to the reservoir 14. Thus, the system 10 can continue to provide water without interruption. If desired, the partially emptied bottle 18*d* also can be used in place of an empty bottle, e.g., 18*a*, as long as sufficient water is in the reservoir 14 during the change over. In any event, maintaining the water in the reservoir at least at a predetermined level, prevents emptying of the reservoir and having the pump 17 run dry which would then require at least priming of the pump before resuming normal operation.

Figure 9:
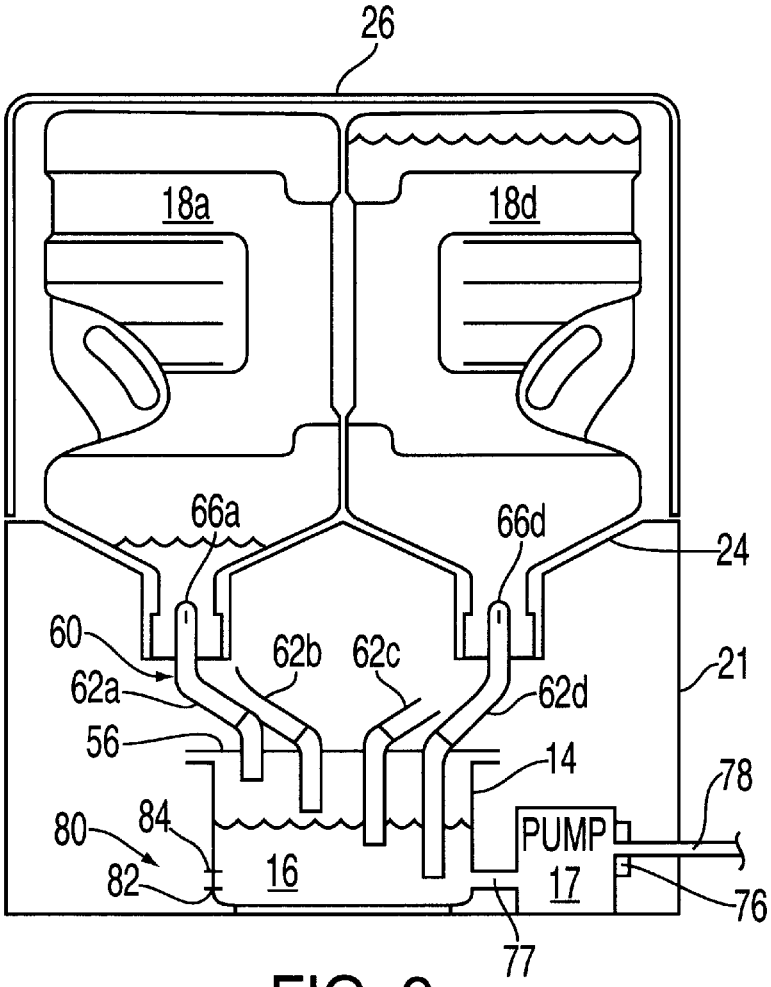
FIG. 9 is a vertical cross-sectional view of another embodiment of a dispenser of the present invention.
Figure 10:
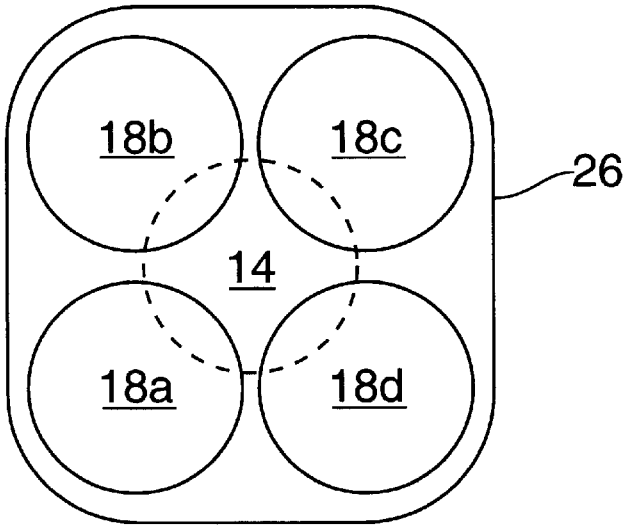
FIG. 10 is a plan view, partially in section, of FIG. 8.

Referring now to FIGS. 9 and 10, there is shown another embodiment of the dispenser 10. The dispenser 12 of FIGS. 9 and 10 is similar to the embodiment shown in FIGS. 1–4. In this instance, however, the bin 21 and tray 24 are integral.

Figure 11:
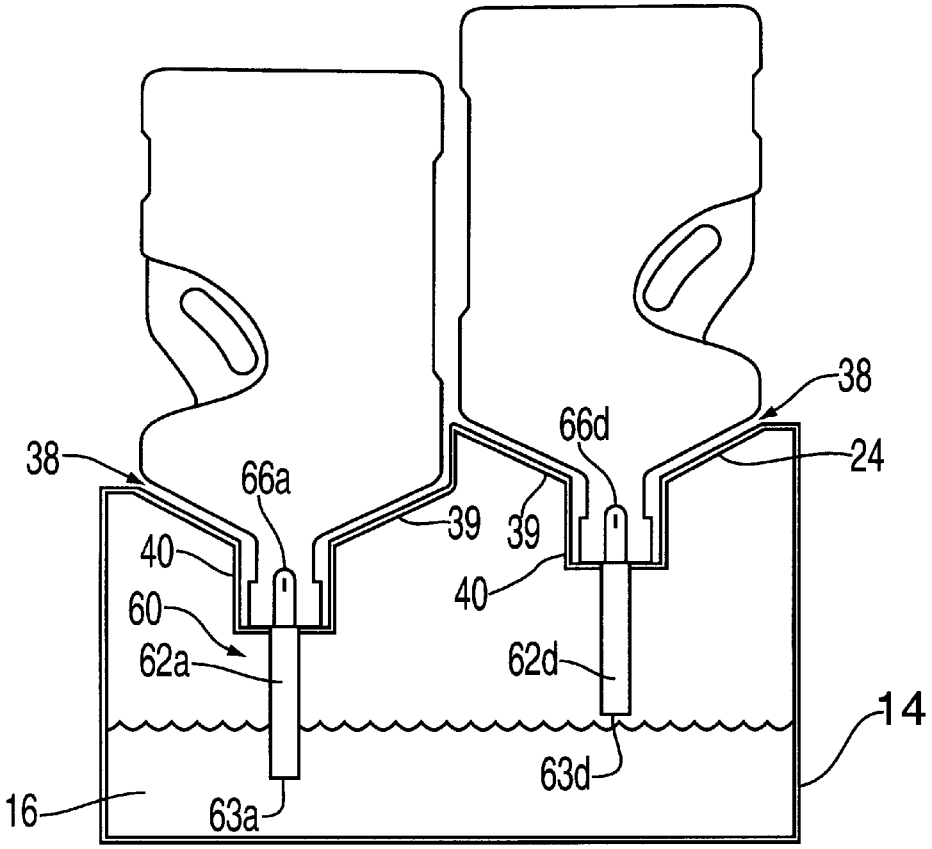
FIG. 11 is a vertical cross sectional view of still another embodiment of the present invention.
Figure 12:
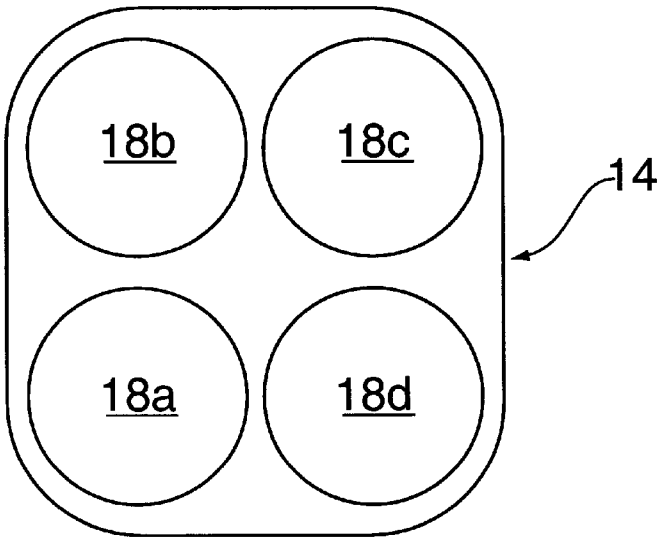
FIG. 12 is a plan view of FIG. 11.
Figure 13:
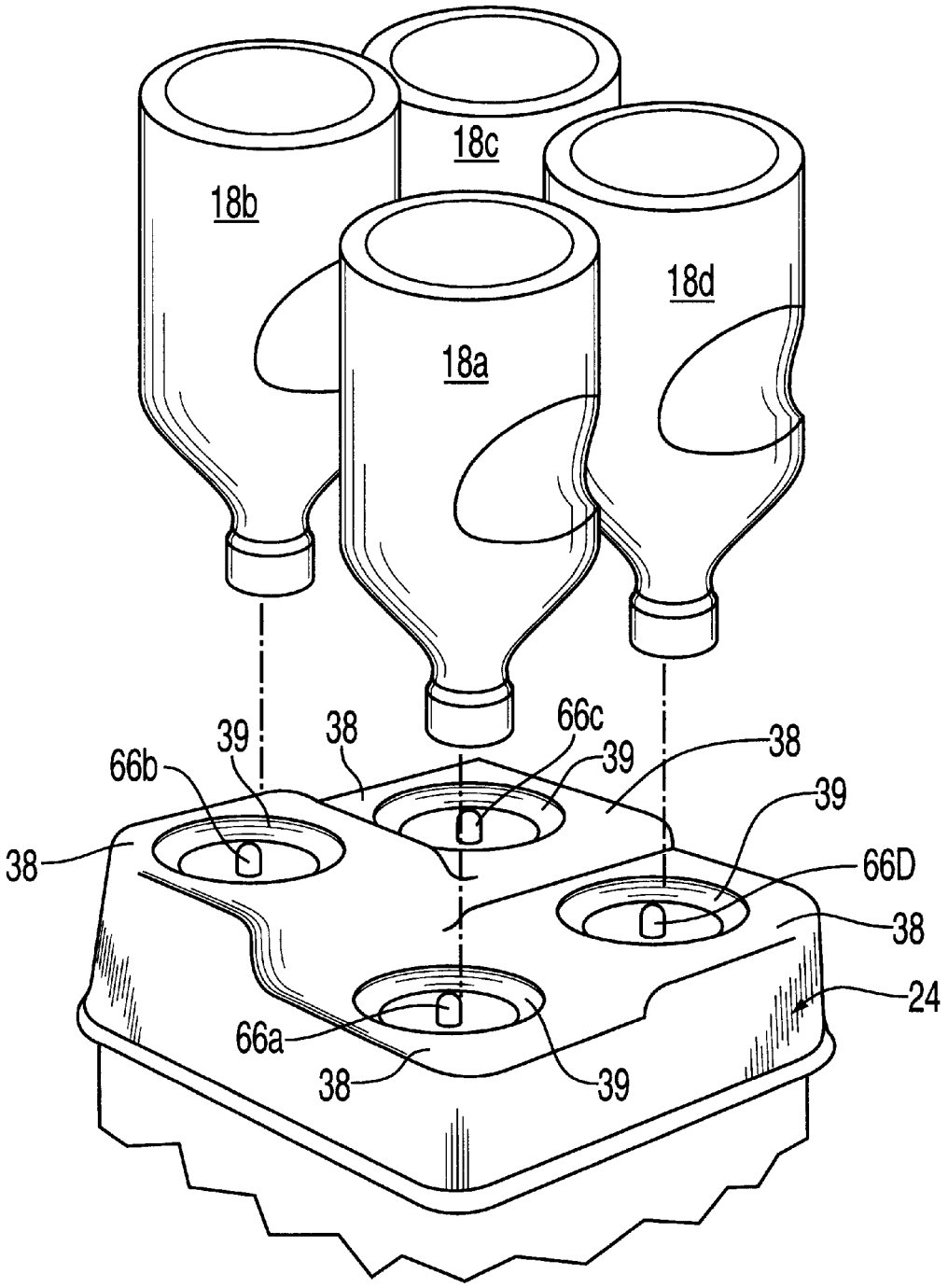
FIG. 13 is an exploded and perspective view of the dispenser of FIG. 11 without the conduits of the dispensing unit.

Referring to FIGS. 11–13, there is shown another embodiment of the present invention which sequentially dispenses water from the containers 18*a–d*. In this embodiment, the conduits 93*a–d* have open ends and are of the same length, and the containers 18*a–d* are positioned at different heights. As illustrated, the containers 18*a–d* generally can maintain their side by side relationship, but they are coextensive only along portions of their heights or lengths. Further, in positioning the containers 18*a–d* as described, the system 10 with conduits 93*a–d* of equal lengths, effectively operates the same way as the system 10 of FIG. 1 (in which the containers 18*a–d* are at the same height and the lengths of the conduits 62*a–d* differ). In the embodiment of the system 10 shown in FIGS. 11–13, the containers 18*a–d* are maintained at different heights by the tray 94 which, in this case, has receptacles 95*a–d* of different heights for the bottles 18*a–d* (FIG. 13).

Figure 14:
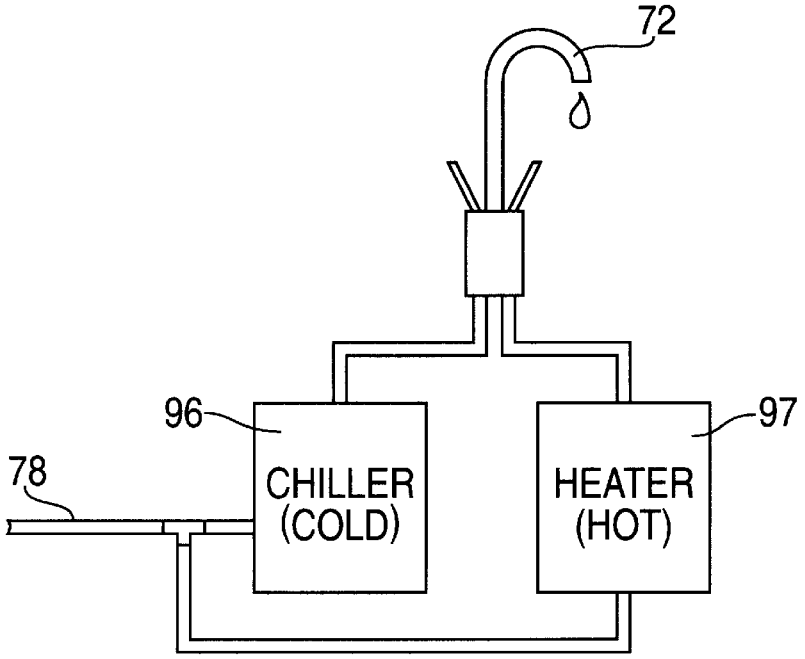
FIG. 14 is a schematic view of an embodiment of the present invention in which the supply line includes a chiller and heater for providing chilled or heated water.

With respect to FIG. 14, there is shown a system 10 which includes a supply conduit 78 connected to a chiller 96 and a heater 97 to deliver water to the faucet 72 at a desired temperature.

Figure 15:
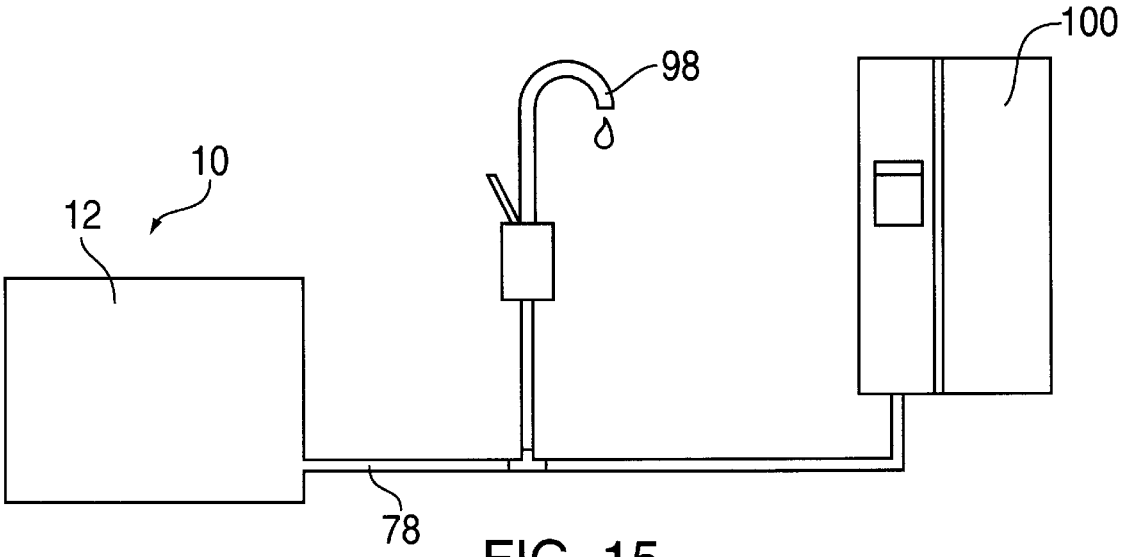
FIG. 15 is a schematic view similar to FIG. 1 in which the water is supplied to multiple outlets: a faucet, an ice maker and an ice/water dispenser.
Figure 16:
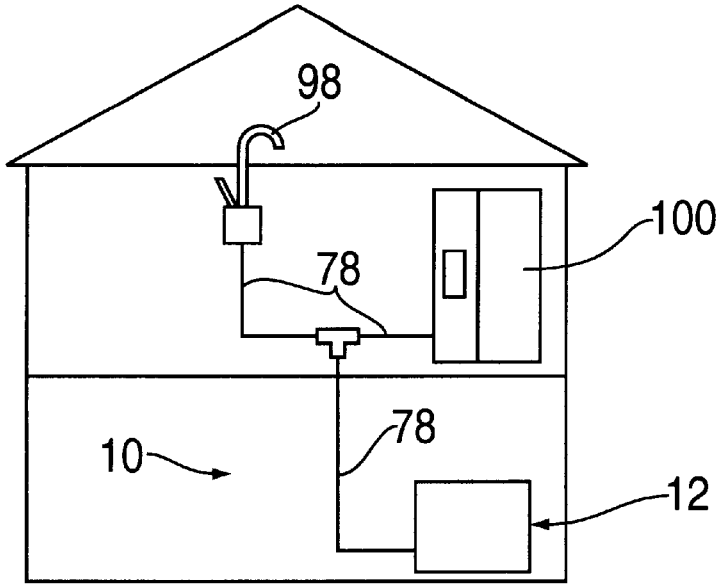
FIG. 16 is a schematic view of an embodiment of the present invention in which the dispenser is stored at one level in a house (e.g., the basement) and the water is dispensed to multiple outlets or sources at a different level of the house (e.g., the kitchen)
Figure 17:
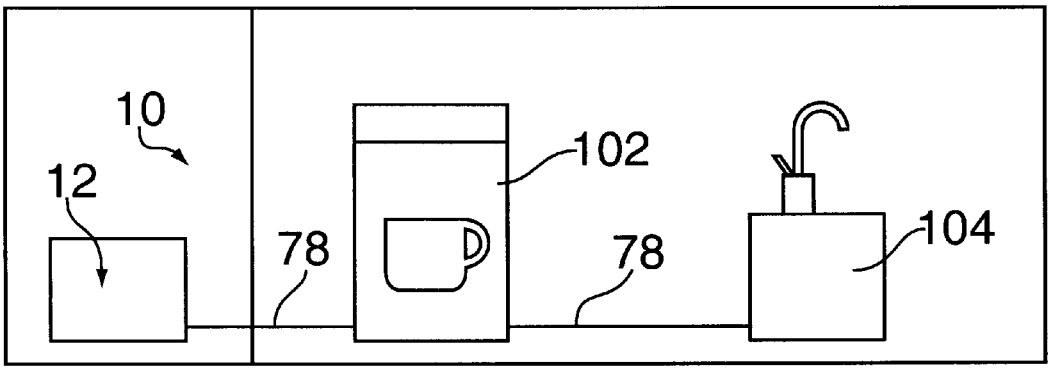
FIG. 17 is a schematic view of another embodiment of the present invention in which the dispenser is maintained in a storage room and the bottled water is dispensed to a coffee maker and faucet (e.g., for industrial, commercial or dining facilities).

Referring now to FIGS. 15–17, these figures illustrate systems 10 for delivering water to multiple outlets 72. In FIG. 15, the water from the system 10 is supplied to a faucet 98 and a refrigerator 100 (ice maker and water dispenser); in FIG. 16, the system 10 is maintained at one level (e.g., the basement) and delivers the water to another level (kitchen) which multiple outlets are located (faucet 98 and refrigerator 100); and in FIG. 17, the system 10 is maintained at a remote location (e.g., a storeroom) and provides water to a coffee maker 102 and a water fountain 104 in another room, such as may be found in homes, commercial and industrial buildings, restaurants and other establishments.

Having described specific embodiments of the invention with reference to the accompanying drawings, it will be appreciated that the present invention is not limited to the illustrative embodiments, and that various changes and modifications can be effected without departing from the scope or spirit of the invention as recited in the appended claims. For example, while the system is shown utilizing a pump, it is foreseen that the system could operate without a pump, such as by the force of gravity. Also the openings in the conduits for sequentially discharging liquid into the reservoir can be at different positions along the lengths of the conduits rather than at or in the lower ends thereof. In addition, it will be appreciated that, although the illustrative embodiments of the present invention have been described with respect to the use of bottled water, other liquids can be dispensed by the system of the present invention, such as beverages, including softdrinks, juices, milk, tea, coffee and the like.

What is claimed is:

1. A system for delivering liquid held in containers, comprising:

a dispenser for holding a plurality of containers in a generally side by side and adjacent relationship, and for releasing the containers when the containers generally are empty and are ready to be replaced by new containers;

a dispensing unit connected to each of the containers for sequentially dispensing the liquid from the containers held by said dispenser, said dispensing unit including a plurality of conduits, each conduit being coupled to an opening of one of the plurality of containers; and a reservoir connected to the containers by said dispensing unit, the reservoir including a chamber, the reservoir receiving the liquid sequentially dispensed by said unit and holding the liquid ready for use, each conduit emptying into the chamber.

2. The system of claim 1, wherein the containers have openings therein for the flow of liquid therethrough, and wherein said dispenser includes receptacles positioned above said reservoir for releasably holding the containers with their openings positioned in the direction of said reservoir.

3. The system of claim 2, wherein said conduits have openings for the sequential dispensing of the liquid from the containers into said reservoir and wherein at least one of said conduits has an opening which is located at a different depth from the openings of the other conduits.

4. The system of claim 3, wherein said receptacles hold the containers at the same height above said reservoir, and wherein said conduits are of different lengths and said openings therein are at the ends of said conduits.

5. The system of claim 3, wherein said receptacles hold the containers at different heights above said reservoir, and wherein said conduits are of the same length and said openings therein are at the ends of said conduits.

6. The system of claim 1, wherein said system further comprises a unit connected to said reservoir and at least one outlet for delivering liquid from said reservoir upon demand by and to said outlet.

7. The liquid delivery system of claim 6, wherein said delivery unit is connected to a plurality of outlets for delivering liquid upon demand by any or all of said outlets.

8. The system of claim 6, wherein the liquid flows from the reservoir to the at least one outlet via gravity.

9. The system of claim 6, wherein the liquid flows from the reservoir to the at least one outlet via a pump.

10. The liquid delivery system of claim 1, wherein said system includes a device operatively connected to said reservoir which indicates when the level of the liquid in said reservoir reaches a predetermined level.

11. The liquid delivery system of claim 10, wherein said system includes a device operatively connected to said reservoir which halts the further flow of liquid from said reservoir when the level of the liquid in said reservoir drops below a predetermined level.

12. The system of claim 1, wherein the liquid is water.

13. A system for delivering liquids held in containers having openings for the flow of liquid therefrom, comprising:

a dispenser for releasably holding the containers in a generally side by side and adjacent relationship with the containers' openings positioned to discharge liquids therefrom;

a reservoir spaced from the containers' openings, the reservoir including a chamber, the reservoir receiving and holding the contents of the containers;

a unit having conduits which are connected at one end to the openings in the containers and which extend into said chamber and wherein said other ends have openings therein at different depths for sequentially dispensing the liquids from the containers into said chamber as said openings of said conduits in said chamber become uncovered as the liquid level therein sequentially drops below said conduit openings;

a unit operatively connected to said reservoir and an outlet for delivering liquid from said reservoir upon demand to said outlet; and a device operatively connected to said reservoir which indicates when the level of the liquid in said reservoir drops to a predetermined level, to thereby allow for the removal of generally emptied containers releasably held by said dispenser and for replacement of the generally emptied containers with filled ones.

14. The system of claim 13, wherein the liquid is water.

15. The system of claim 13, wherein the liquid flows from the reservoir to said outlet via gravity.

16. The system of claim 13, wherein the liquid flows from the reservoir to said outlet via a pump.

* * * * *